United States Patent [19]

Carleton et al.

[11] Patent Number: 4,712,040

[45] Date of Patent: Dec. 8, 1987

[54] CONNECTOR FOR HIGH PRESSURE LAMPS

[75] Inventors: Samuel A. Carleton, Bath; Norman R. King, Hammondsport, both of N.Y.

[73] Assignee: North American Philips Corporation, New York, N.Y.

[21] Appl. No.: 799,526

[22] Filed: Nov. 19, 1985

[51] Int. Cl.[4] ..... H01J 5/50

[52] U.S. Cl. ..... 313/331; 313/318; 313/42

[58] Field of Search ..... 313/318, 25, 574, 623, 313/50, 331

[56] References Cited

U.S. PATENT DOCUMENTS

| | | | |
|---|---|---|---|
| 2,715,691 | 7/1951 | Meister | 313/25 |
| 3,218,495 | 11/1965 | Hasell et al. | 313/25 |
| 3,610,983 | 10/1971 | Grabner et al. | 313/25 |
| 4,382,205 | 5/1983 | Strok | 313/25 |
| 4,581,557 | 4/1986 | Johnson | 313/25 |
| 4,599,543 | 7/1986 | Strok | 313/25 |

*Primary Examiner*—David K. Moore
*Assistant Examiner*—Mark R. Powell
*Attorney, Agent, or Firm*—Robert T. Mayer

[57] ABSTRACT

A high pressure discharge lamp having a wire connected to at least one of the electrode assemblies of its arc tube. The wire is formed with two separated legs joined at a common point. The legs are both bent toward the common point. The distance between the legs of the wire contracts and expands to compensate for the expansion and contraction of the lamp's arc tube as the lamp is turned on and off.

4 Claims, 3 Drawing Figures

FIG.1
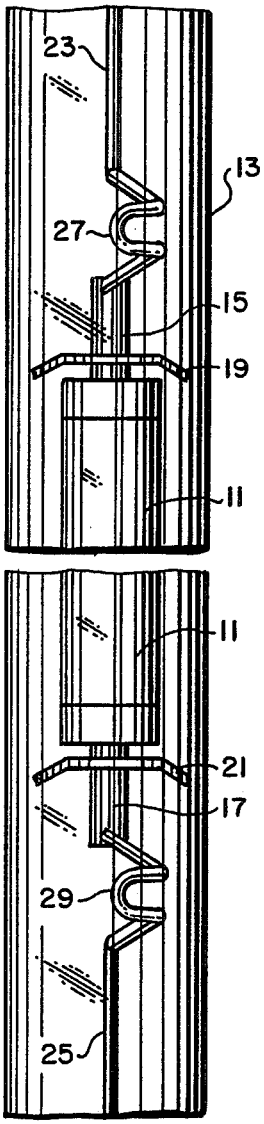
FIG.2
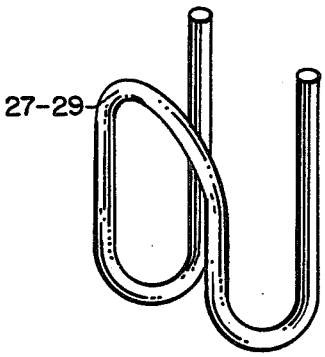
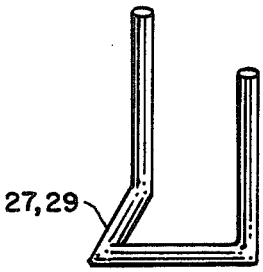
FIG.3

CONNECTOR FOR HIGH PRESSURE LAMPS

This is an invention in lighting. More particularly, it involves an improvement in high pressure discharge lamps.

The arc tube of a high pressure lamp is made of a different material than that of the electrical connections to its electrode assemblies. Because of this it is common practice to provide as a part of the electrical connections an element which can expand and contract with the heating and cooling of the lamp. This element normally takes the form of a bent wire of a metal such as niobium which is typically welded to a lamp electrode assembly. Because this wire is worked each time the lamp is turned on and off, it and its weld are frequently the causes of failure of a lamp.

It is an object of this invention to provide an improved high pressure lamp.

One of the advantages of the invention is that it provides a longer lasting high pressure lamp.

One of the features of the invention is the provision of unique wire connectors for the electrode assemblies of high pressure lamps.

Another advantage of the invention is it takes up more of an arc tubes expansion and contraction movement than prior connectors. Also, smaller forces are transmitted to the welds on the electrode assemblies because the invention makes it possible to provide connectors which are longer than could previously be provided in the same space by connectors of earlier designs.

In accordance with the invention there is provided a high pressure discharge lamp including an arc tube. This tube has two electrode assemblies and is disposed within an outer jacket. A separate electrical connection is provided to each of the electrode assemblies of the arc tube. Each connection extends from the inside to the outside of the outer jacket. At least one of the electrical connections inside the jacket includes a wire connector formed of a bent wire having two legs with a common point. Both legs are bent back toward the common point.

Other objects, features and advantages of the invention will become apparent from the following description and appended claims when considered in conjunction with the accompanying drawing in which corresponding elements in the various figures are identified by the same reference characters and in which:

FIG. 1 is a partial schematic view of a high pressure lamp made in accordance with the invention;

FIG. 2 is a three-dimensional view of a wire connector used in practicing the invention; and FIG. 3 is a three-dimensional view of an alternative to the wire connector of FIG. 2.

Referring to FIG. 1 there is shown an arc tube 11 disposed within an evacuated outer jacket 13. At the ends of arc tube 11 are electrode assemblies 15 and 17. Mounted on electrode assemblies 15 and 17 are centering devices 19 and 21, respectively. These devices are provided in jacket 13 for locating arc tube 11 relatively centered therein.

Electrical connections 23 and 25 are brought into jacket 13 from outside (not shown). Each electrical connection includes an expandable element 27 and 29 which are connected in any appropriate manner to electrode assemblies 15 and 17 such as by welding.

Each expandable element is formed of a U-shaped wire with the bottom of the U bent back toward its open end as shown in FIG. 2.

An alternative would be a V-shaped wire having two legs joined at a common point with each leg bent toward the common point, as shown in FIG. 3.

The arrangement disclosed herein is for descriptive purposes and it is not to be considered restrictive.

What is claimed is:

1. A high pressure discharge lamp comprising an arc tube disposed within an outer jacket, an electrode assembly at each end of said arc tube and a separate electrical connection to each of said electrode assemblies, each said connection for connecting said arc tube from the inside to the outside of the outer jacket, each said connection inside the jacket including wire connector means fixedly connected to its associated electrode assembly, each said wire connector means being formed of a bent wire having two separated legs joined at a common point and comprising a U-shaped wire with the bottom of the U bent back toward its open end, each said wire connector means being so disposed relative to its associated electrode assembly that expansion of said arc tube when the lamp is turned on forces said legs of said connector means closer together and contraction of said arc tube when the lamp is turned off forces said legs apart.

2. A high pressure discharge lamp comprising an arc tube disposed within an outer jacket, an electrode assembly at each end of said arc tube and a separate electrical connection to each of said electrode assemblies, each said connection for connecting said arc tube from the inside to the outside of the outer jacket, at least one of said connections inside the jacket including wire connector means fixedly connected to its associated electrode assembly, said wire connector means being formed of a U-shaped wire with two separated legs and the bottom of the U bent back toward its open end, said wire connector means being so disposed relative to said associated electrode assembly that expansion of said arc tube when the lamp is turned on forces said legs of said connector means closer together and contraction of said tube when the lamp is turned off forces said legs apart.

3. A high-pressure discharge lamp comprising an arc tube disposed within an outer jacket, an electrode assembly at each end of said arc tube and a separate electrical connection to each of said electrode assemblies, each said connection for connecting said arc tube from the inside to the outside of the outer jacket, at least one of said connections including wire connector means fixedly connected to its associated electrode assembly, said wire connector means inside the jacket formed of a V-shaped wire with two separated legs and the bottom of the V bent back towards its open end, said wire connector means being so disposed relative to said associated electrode assembly that expansion of said arc tube when the lamp is turned on forces said legs of said connector means closer together and contraction of said arc tube when the lamp is turned off forces said legs apart.

4. A high pressure discharge lamp comprising an arc tube disposed within an outer jacket, an electrode assembly at each end of said arc tube and a separate electrical connection to each of said electrode assemblies, each said connection for connecting said arc tube from the inside to the outside of the outer jacket, each said connection inside the jacket including wire connector means fixedly connected to its associated electrode assembly, each said wire connector means being formed of a bent wire having two separated legs joined at a common point and comprising a V-shaped wire with the bottom of the V being bent back toward its open end, each said wire connector means being so disposed relative to its associated electrode assembly that expansion of said arc tube when the lamp is turned on forces said legs of said connector means closer together and contraction of said arc tube when the lamp is turned off forces said legs apart.

* * * * *